US006499934B1

(12) United States Patent
Kaczmarski et al.

(10) Patent No.: US 6,499,934 B1
(45) Date of Patent: Dec. 31, 2002

(54) IMPLEMENT ATTACHMENT BRACKET FOR SKID STEER LOADER MOUNTING PLATE

(75) Inventors: Wally L. Kaczmarski, Lisbon, ND (US); Craig A. Berard, Oakes, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/570,270

(22) Filed: May 12, 2000

(51) Int. Cl.[7] ..... E02F 9/00
(52) U.S. Cl. ..... 414/723; 37/468
(58) Field of Search ..... 414/723; 37/468

(56) References Cited

U.S. PATENT DOCUMENTS

| | | | | |
|---|---|---|---|---|
| 4,571,146 A | | 2/1986 | Eriksson | 414/687 |
| 4,881,867 A | | 11/1989 | Essex et al. | 414/723 |
| 4,945,662 A | | 8/1990 | Kreye | 37/103 |
| 4,955,779 A | | 9/1990 | Knackstedt | 414/723 |
| 5,082,065 A | | 1/1992 | Fletcher | 172/273 |
| 5,098,252 A | * | 3/1992 | Sheesley et al. | 414/723 |
| 5,562,397 A | | 10/1996 | Albright | 414/723 |
| 5,820,332 A | | 10/1998 | Philips et al. | 414/723 |
| 5,938,399 A | | 8/1999 | Knutson | 414/722 |
| 5,974,706 A | | 11/1999 | Kaczmarski et al. | 37/468 |
| 5,983,535 A | | 11/1999 | Kaczmarski et al. | 37/468 |

FOREIGN PATENT DOCUMENTS

DE 3200800 A1 7/1983

* cited by examiner

*Primary Examiner*—Donald W. Underwood
(74) *Attorney, Agent, or Firm*—Westman, Champlin & Kelly, P.A.

(57) ABSTRACT

A mounting plate that is attachable to an attachment plate of a skid steer loader supports a quick attachment bracket on a forward side thereof. The quick attachment bracket has one part forming a nose, and a saddle spaced from the nose. The quick attachment bracket will move into a receptacle portion of a mounting frame on a tool to be driven by the skid steer loader and will receive another portion of the frame in the saddle. The frame and the quick attachment bracket can be held together with a latch arrangement and then the tool manipulated with the skid steer loader lift arms and attachment plate tilt cylinder. The tool is powered from the skid steer loader in a desired manner.

4 Claims, 5 Drawing Sheets

10
12
14
16
18
20
22
23
24
25
26
28
30
32
34
36
37
38
39
40
40A
42
44
46
60
61
62
64
66
68
68A
70
71
72
74
76
78
80
81A
82
88
90

IMPLEMENT ATTACHMENT BRACKET FOR SKID STEER LOADER MOUNTING PLATE

BACKGROUND OF THE INVENTION

The present invention relates to an attachment mounting plate used with skid steer loaders that includes a quick attachment bracket so that quick attachment tools that are used with excavators and backhoe booms can be used with skid steer loaders.

U.S. Pat. No. 5,974,706 shows an attachment bracket of the type shown on the mounting plate in the present application. The attachment bracket is adapted for mounting onto the arm of an excavator or backhoe, which in turn receives and mounts a frame. A version of the attachment bracket device that uses a fastener for securing the frame on the bracket is illustrated in U.S. Pat. No. 5,983,535. Both of these patents show prior art devices that are used for mounting various tools on excavator or backhoe booms. The tools can be used with skid steer loaders with the present invention.

When tools or attachments that are used on one prime mover, such as an excavator, also can be quickly mounted on a skid steer loader, efficiencies are produced, inventory of tools needed is reduced and the tool becomes more universally usable. Mounting an attachment bracket on the loader mounting plate permits using various tools that have mounting frames on them and which are used with other machines, such as backhoes or excavators.

SUMMARY OF THE INVENTION

The present invention relates to mounting an attachment bracket on a loader accessory or attachment mounting plate that permits quickly mounting tools that have a mating frame. Such tools include hydraulic breakers, vibrating plate compactors, earth augers, grapples, specialized buckets, cutter crushers, and trenchers, for example. The tools thus are usable with skid steer loaders as well as other prime movers so versatility and tool utilization are increased.

The loader mounting plate that supports the tool in turn is supported on the boom or arms of a skid steer loader and can be tilted under control of a hydraulic actuator about a horizontal pivot.

Skid steer loaders, such as those sold under the trademark BOBCAT® by Bobcat/Ingersoll-Rand, have long used a quick change attachment plate on the outer ends of the arms or boom of the skid steer loader, and which has latch members that will positively hold an accessory mounting plate in position. The adapter or mounting plate is used to mount an accessory or work attachment and when the accessory is removed and a new accessory installed, the new accessory has a different mounting plate. The loader mounting plates have been used for mounting various implements.

It has been found that the ability to mount tools that have frames which mount onto quick attachment brackets on backhoe booms, excavator booms, or the like for direct mounting to a mating bracket on the skid steer loaders increases the usefulness of the tools, and widens their application without specialized mounting brackets or frames. The common mounting frame not only increases the use of the tools, but also provides additional uses for the skid steer loader.

The mounting or adapter plates have been used for mounting attachments for loaders, such as brooms, powered earth augers, backhoes, and various kinds of buckets, as well as concrete breakers and many landscape tools. The present invention relates to the use of one mounting plate for mounting a quick change bracket that will receive a mating frame supported on specialized buckets, cutter crushers, hydraulic breakers, vibrating plate compactors, earth augers, grapples, trenchers and other tools and permit such tool or bucket to be secured in place quickly and easily.

The quick change bracket on the mounting plate of a loader is standardized in configuration for receiving a wide range of tools that also mount onto backhoe arms or booms or excavator booms at the present time.

DETAILED DESCRIPTION OF THE ILLUSTRATIVE EMBODIMENTS

Figure 1:
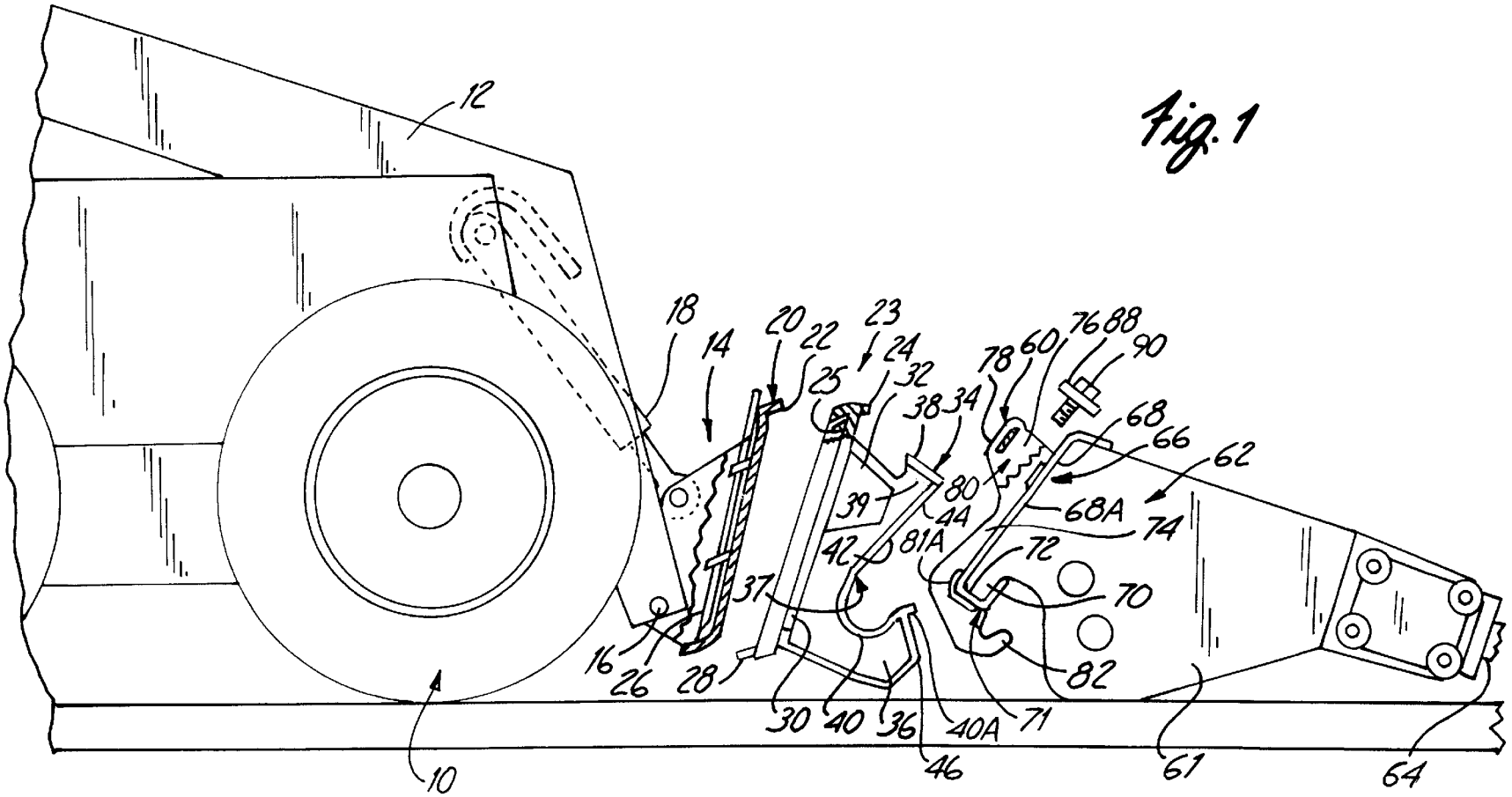
FIG. 1 is a schematic exploded view of a forward portion of a skid steer loader showing a loader accessory mounting plate having a quick change bracket installed thereon in a position to support a tool.

A skid steer loader indicated generally at 10 is of conventional design, and is shown only schematically. It has a pair of loader arms, indicated at 12 which can be raised and lowered under power. The forward ends of the boom or arms have an accessory attachment plate 14 mounted to the arms about a horizontal pivot 16. The attachment mounting plate 14 can be tilted about the pivot 16 extending and retracting a hydraulic actuator 18 that is shown schematically and in dotted lines.

The attachment plate 14 is provided with a latch assembly indicated generally at 20 that is well known, and for example is illustrated as including a power actuator in U.S. Pat. No. 5,562,397, and is of the type generally as shown in U.S. Pat. Nos. 3,672,521 and 3,732,996.

A mounting plate assembly 23 has a mounting plate 24 that is adapted to be supported on the attachment plate 20. As shown, the attachment plate 20 has a top lip 22 that will fit under an upper flange 25 on the mounting plate 24. A pair of vertically movable wedges illustrated schematically at 26 are made so that they will fit into apertures in a bottom latching plate 28 on the mounting plate 24, to permit mounting the mounting plate 24 onto the attachment plate 20 and locking it in position. The lever or latch assembly 26 includes manual levers for moving the wedges, or can be power operated as previously mentioned.

Figure 2:
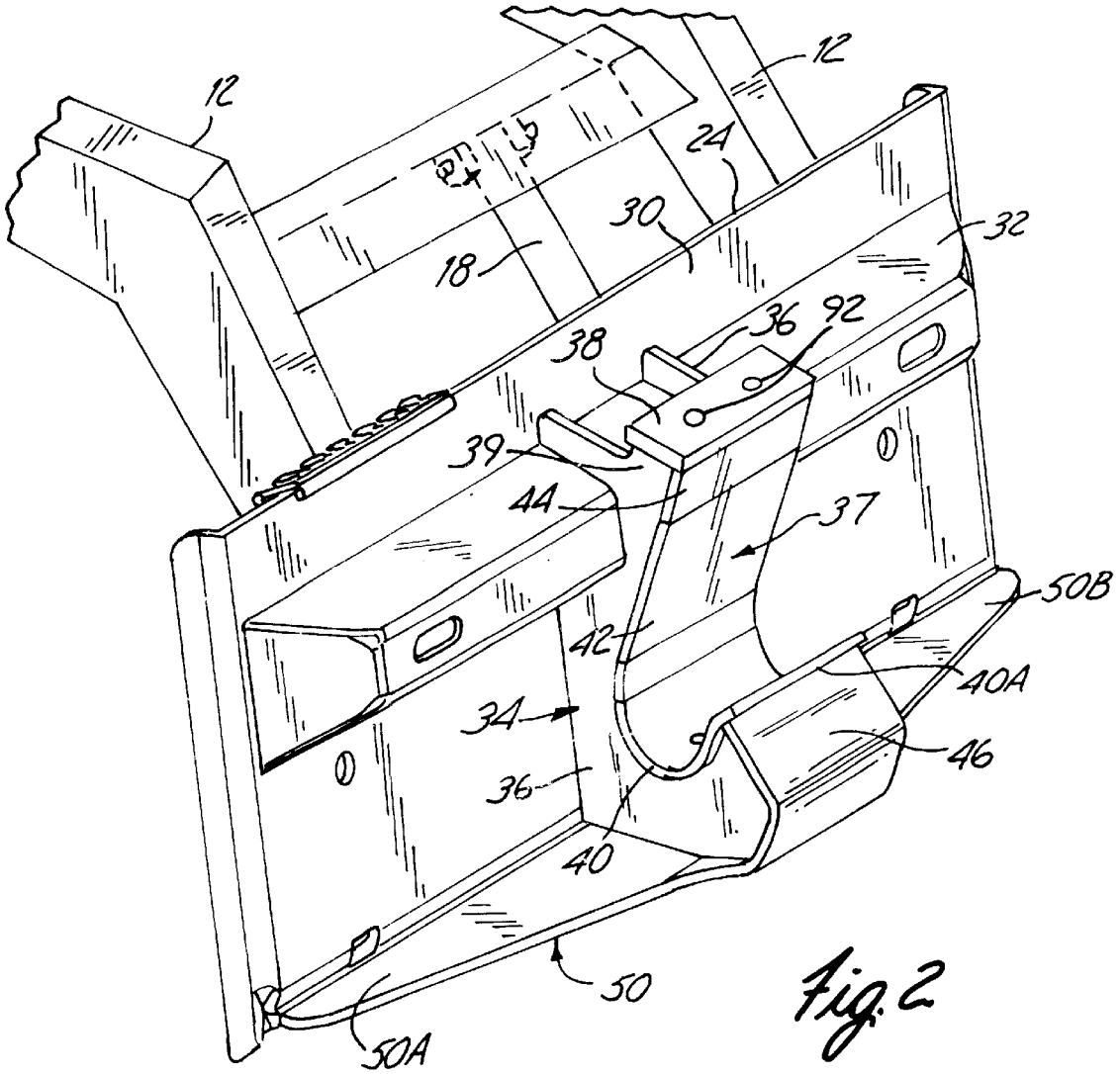
FIG. 2 is a perspective view of the mounting plate and bracket shown in FIG. 1.

The mounting plate 24 of the present invention extends laterally across the front of the loader arms, generally as shown in FIG. 2, and includes a main mounting wall 30 that has a laterally extending reinforcing channel 32 on the forward surface thereof. A quick attachment bracket 34 is mounted onto the mounting wall 30 and reinforcing channel 32 and is welded in position. The attachment bracket 34 includes a pair of side plates 36, 36, which are spaced apart, and which in turn support a cross nose bar 38 at an upper end. The nose bar 38 is supported on ears 39 on the side plates and forms a first support for a mating frame.

The side plates 36 of the quick attachment bracket 34 are formed at a lower end into a generally "C" or "U" shape and receive a unitary formed plate 37 that has a formed "C" or "U" shaped saddle or retainer 40 at one end, that opens upwardly. The plate 37 has a backing plate portion 42 that extends between the side plates 36, 36. The saddle 40 forms a second support for supporting mating frames on working tools. A cross bar portion 44 of plate 37 is adjacent an outer end of the bracket 34 and provides additional support for the nose bar 38. The side plates 36 are also joined together with a forward brace wall 46, that as shown, is formed around the forward or outwardly facing portions of the bracket 34, and can be welded to a lip 40A of the saddle 40. The brace wall 46 is formed from a plate that also includes a lateral brace plate 50 that is in turn tapered back toward the opposite ends or sides of the wall 30, in wing portions 50A and 50B. The wing portions 50A and 50B are in turn welded to the wall 30 for reinforcement.

The bracket 34 that is described, is essentially the same as the bracket shown in U.S. Pat. No. 5,983,535, and similar to that shown in U.S. Pat. No. 5,974,706, except the form shown does not have an automatic latch as shown in the '706 patent and is mounted on and braced to the loader attachment mounting plate 24. An automatic latch could be provided.

Figure 3:
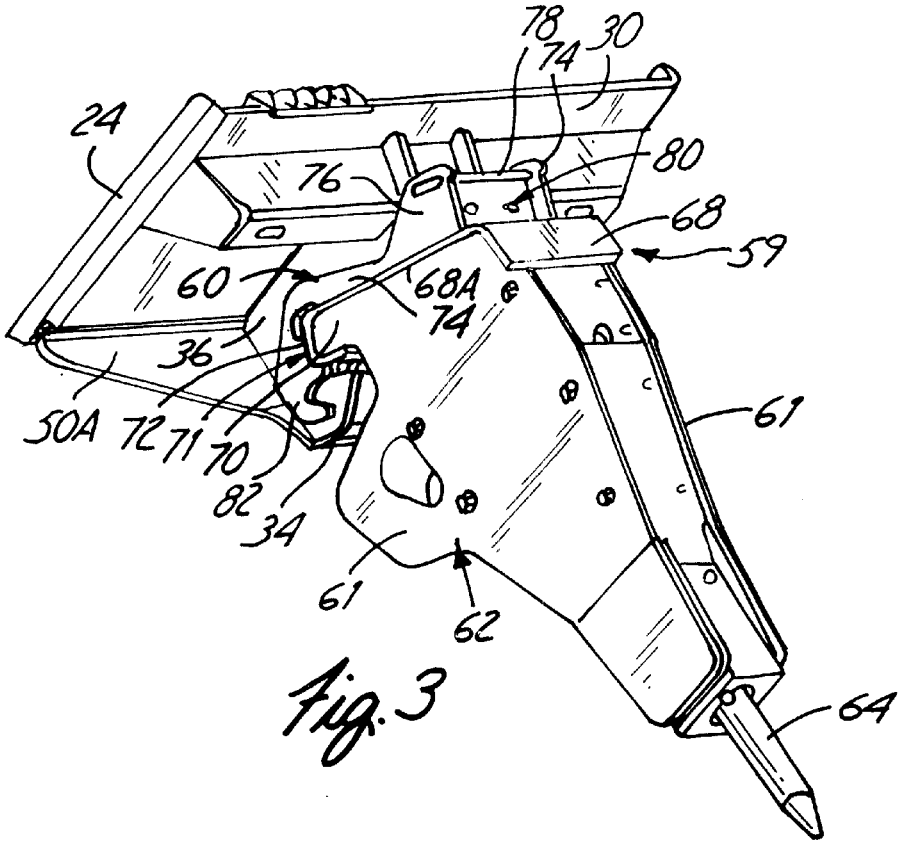
FIG. 3 is a perspective view of the mounting plate and bracket with a typical tool that has a frame that fits onto the bracket in place on the tool.
Figure 4:
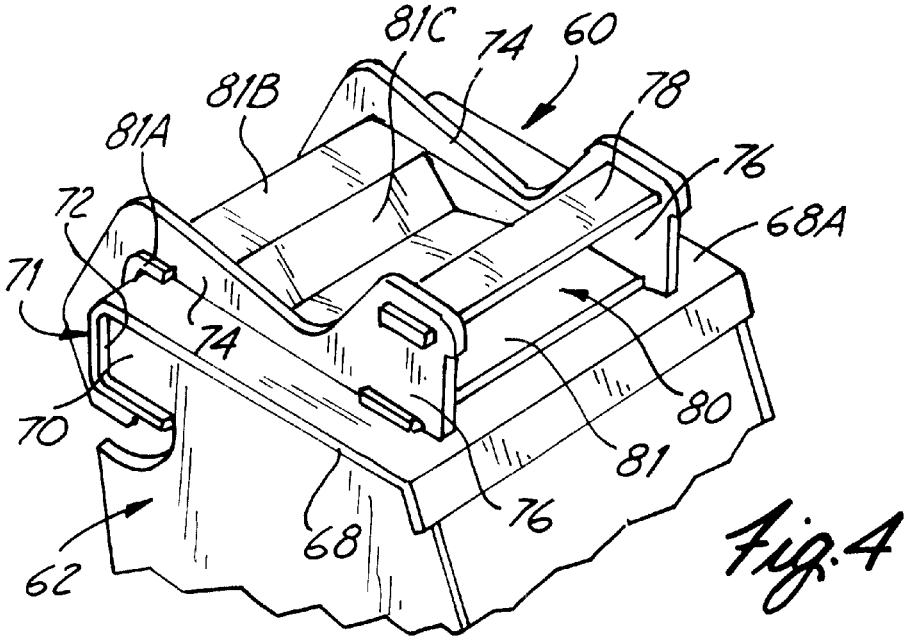
FIG. 4 is a perspective view of the bracket and a fragmentary showing of the tool.

The bracket 34 is made to receive and support a frame 60 that forms part of a quick attachment assembly shown at 59 in FIG. 3. The frame 60 is fixedly mounted onto a tool 62. In the illustrative embodiment, the tool is a hydraulic "breaker" which includes a hydraulically driven motor that will reciprocally drive a breaking point or tool shown at 64 for breaking concrete or the like. The frame 60 is mounted onto an end portion 66 of the tool 62, and has a lateral width that spans the width of the tool, as can be seen in FIGS. 3 and 4. The end portion 66 supports a frame cross plate 68, and it is fixed to the side plates 61, 61 of the tool 62. As shown, one end of the cross plate 68 is formed into a "U" shaped channel member 72 around end ears or members 70 of side plates 61 of the tool. This "U" shaped channel member 72, can be seen in FIGS. 3 and 4 and a plate 81 that overlies the plate 68 is bent partially around the channel as shown at 81A. The "U" shaped channel member 72 and bent portion 81A form a retainer bar 71 of size to fit within and be retained by the saddle 40 on the quick change bracket 34, when the frame 60 is seated in the bracket 34. The side plates 74, 74 fit to the outside of the plates 36 and the ends of saddle 40, and plate portion 42 and 44, of the bracket 34, when the frame 60 is mounted on bracket 34.

The side plates 74 have ear portions 76 at the second end, opposite the "U" shaped channel member 72. The ear portions 76 mount a cross retainer bar 78. The cross retainer bar 78 is spaced from the plane of the main portion 81B of cross plate 81, to form a slot or receptacle 80 that is of size to receive the nose bar 38 and the end ears 39 to hold the frame 60 in place on the bracket 34. The main portion 81B of plate 81 is bent into a provided opening in plate 60 as shown at 81C to form a latch face, as shown in more detail in U.S. Pat. No. 5,974,706.

The side plates 74 also have hook ends shown at 82, adjacent the channel member 72, and these can be used for suspending the frame 60 and the attached tool on pins that are attached to the bracket, and which are not used with the skid steer loader. Such support pins are shown in U.S. Pat No. 5,983,535.

When the tool is to be mounted onto the mounting plate assembly 24 and particularly the mounting plate 24 and the bracket 34, with the tool resting as shown in FIG. 1, the mounting plate 24 may first be attached to the attachment plate 14 in a conventional manner so the mounting plate 24 can be lifted with the loader arm 12. If desired, the mounting plate and bracket 34 can be coupled to frame 60 and tool 62 before coupling the plate 24 to the attachment plate 14.

However, when the mounting plate 24 is coupled to the attachment plate 14 it can be tilted about the axis of pins 16. If the mounting plate 24 is on the attachment plate 14 it can be moved to position the saddle 40 underneath and aligned with the retainer 71 formed by channel member 72 and bent portion 81A of the plate 81 on frame 60, by sliding the mounting bracket 34 substantially parallel to the main portion of the plate 81, the nose bar 38 will enter the slot or receptacle 80, and when the retainer 71 seats in the saddle 40, the nose bar 38 and at least a part of the ears 39 will be under the retaining bar 78. The frame 60 and the quick change bracket 34 can then be locked together by using a cross plate 88 that rests on end edges of the side plates 74 of the frame 60. Suitable threaded fasteners, as shown, cap screws 90, extend through openings in plate 88 and can be threaded into openings 92 or threaded fasteners behind those openings in the nose bar 38 to pull the nose bar 38 toward the cross bar 88, and seat the end member 72 tightly in the saddle 40. The cross plate 88 and fasteners 90 comprise a latch to clamp the bracket 34 and frame 60 together.

Figure 5:
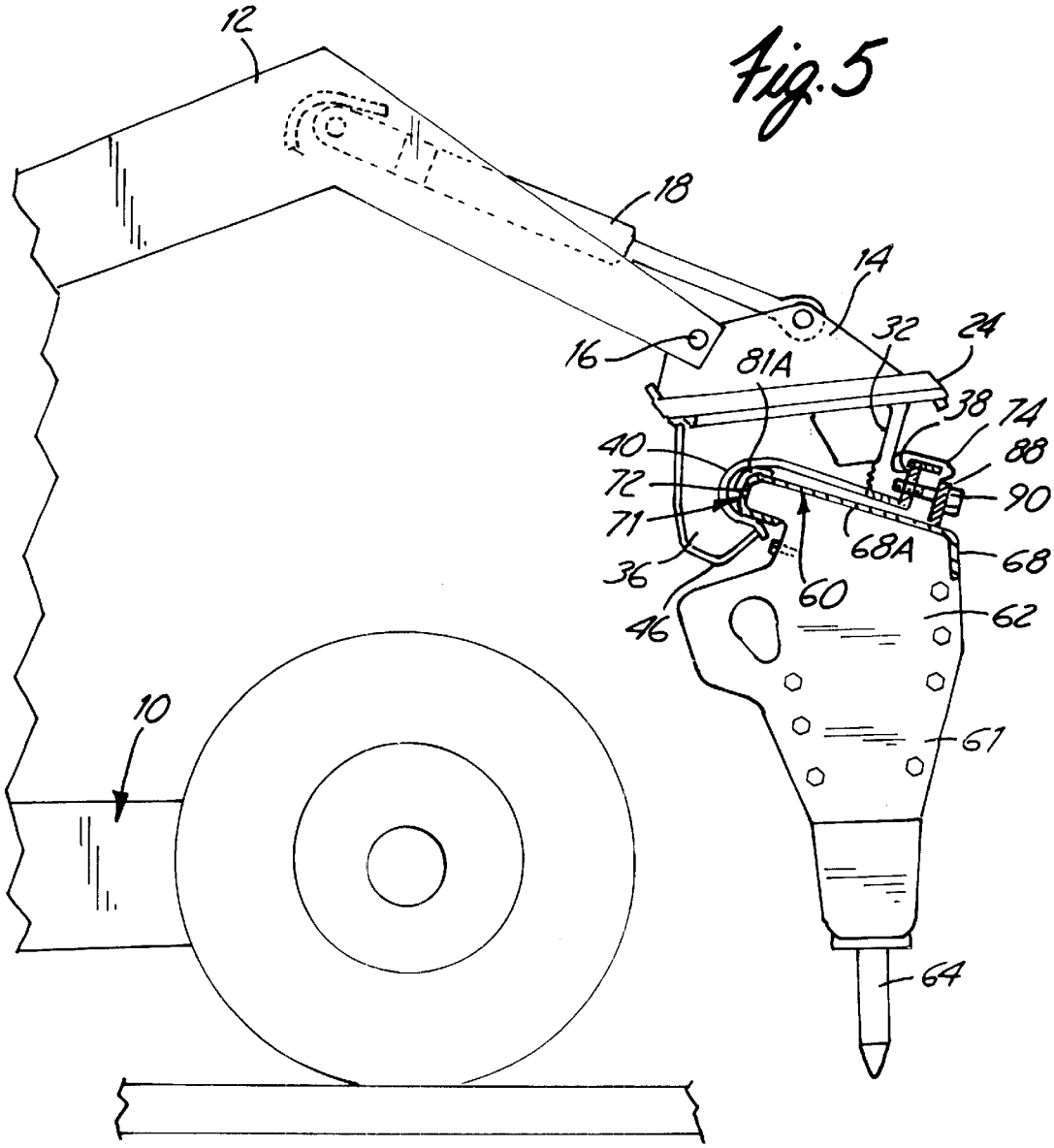
FIG. 5 is a fragmentary view showing the mounting plate, bracket and tool in a working position.

Once the assembly 59 is made as shown in FIG. 3, so that the frame 60 is securely seated in the quick attachment bracket 34, then the tool 62 can be moved to a vertical position or a position in between by lifting the arms 12 and tilting the attachment plate 14 and mounting plate 24 using the cylinder 18, generally as shown in FIG. 5. The actuator 18 for tilting the attachment plate 14 has sufficient movement so that it will move the attachment plate 14 and mounting plate 24 to a substantially horizontal position, that is, parallel to the ground or supporting surface. A breaker such as that shown at 62 can then be used for breaking pavement or the like in a normal manner.

The tool 62 can be easily stored by retracting the actuator 18 and then resting the tool on the ground, generally as shown in FIG. 1. The cap screws 90 are loosened, and the cross plate 88 removed. Then the mounting plate 24 can be lowered by lowering the attachment plate 14 through the use of loader arms 12, and the mounting bracket 34 will slip out of the frame, so that the loader can be moved and the tool left in place. If desired, the mounting plate 24 can be removed from the attachment plate 14 and the bracket 34 and frame 60 left mounted together.

The quick attachment bracket 34 is centered on the mounting plate 24, as shown, but could be positioned to one side or the other if desired. It is however, stably braced back to the wall 30 of the mounting plate 24, and the mounting plate assembly 23, including the mounting plate and bracket 34, can then be used for lifting another tool without requiring the mounting plate 24 to be removed from the attachment plate 14.

Figure 6:
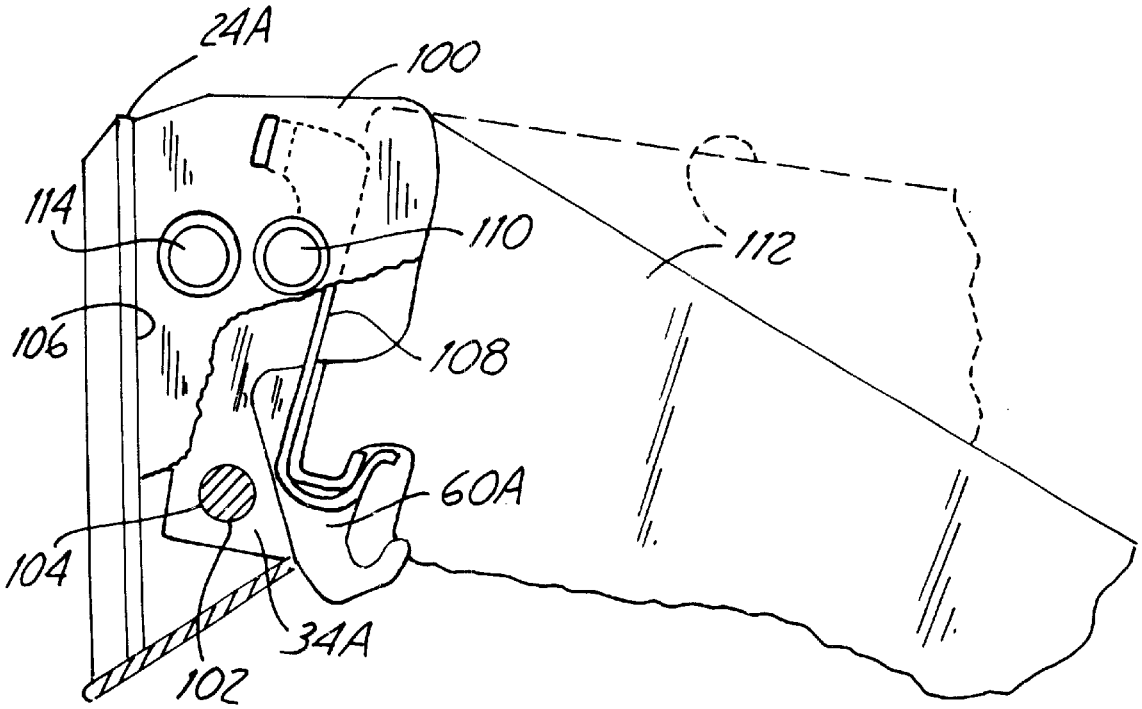
FIG. 6 is a schematic representation of a modified form of the invention that permits adjusting the angle of the quick attachment bracket relative to the mounting plate.

FIG. 6 illustrates a modified form of mounting of the quick change bracket onto the mounting plate. In this form of the invention, the mounting plate is shown at 24A, and a bracket is shown at 34A.

The mounting plate 24A has a pair of laterally spaced apart side plates 100, that include bores for mounting a cross pin 102 that passes through the spaced side plates 104 of the bracket 34A. The plates 100 are spaced apart and welded to a wall member 106 which corresponds to wall 30, and then will have suitable bushings or supports on the side plates 100 for supporting the pin 102. The pin 102 will pass through both of the bracket side plates 104, which correspond to the side plates 36 of the bracket in the first form of the invention.

The angle of the bracket wall portion 108 that corresponds to the wall portion 42, can be changed in this form of the invention. The pin 102 forms a pivot, and the bracket 34A is retained in place with a second pin 110 that passes through bores in the side plates 100, and through suitable openings in the side plates 104 of the bracket 34A to hold the bracket 34A positively in place. The pin 102 can be held with suitable cross pins or the like so that it does not move and the bracket 34A will be held stably.

A tool mounting frame that is shown only fragmentarily at 60A, which corresponds to frame 60 is mounted in the bracket 34A, and is held in the same manner as that previously explained. If the angle of the frame 34A is to be changed, because a particular tool shown at 112, such as a breaker, grapple, crusher, tamper, or the like requires a different angle of projection from the wall 106 that is shown in solid lines, the pin 110 can be removed, and the bracket 34A then pivoted around the pin 102 so that the pin 110 can be placed in a second set of adjustment holes 114 in the side plates 100 on the mounting plate. This will change the angle of the tool shown at 112 to the portion illustrated in dotted lines.

Various forms of an angle adjustment can be made, but the form shown provides for a simple two position angle change.

The bracket 34 is a quick exchange bracket that simplifies the operation of attaching any one of a number of different tools to a loader having lift arms.

It should be noted that, if desired, the frame 34 can be made to include a spring loaded, automatic latch member such as that shown in U.S. Pat. No. 5,974,706. Automatic latching can then be used, where a spring loaded latch is adequate for holding the tool in place.

Although the present invention has been described with reference to preferred embodiments, workers skilled in the art will recognize that changes may be made in form and detail without departing from the spirit and scope of the invention.

What is claimed is:

1. A mounting plate assembly for attachment to an accessory attachment plate of a skid steer loader, comprising a mounting plate having an upper edge and a lower edge, an attachment bracket supported on a forwardly facing surface of the mounting plate and having a nose portion adjacent an upper edge of the mounting plate and a open channel receptacle adjacent the lower edge of the mounting plate, a transverse stiffener supporting the attachment bracket adjacent the upper edge of the mounting plate to stiffen the mounting plate, and a lateral brace between the attachment bracket and the mounting plate adjacent the lower edge of the mounting plate, said attachment bracket nose portion and channel receptacle comprising frame supports, and a frame for mounting on said frame supports of the attachment bracket, said frame being attached to a working tool adapted to be mounted onto another prime mover.

2. The assembly of claim 1, wherein said attachment plate is pivotally mounted on skid steer loader arms, and a hydraulic actuator to control the pivoting of said attachment plate and the mounting plate mounted thereon.

3. The assembly of claim 1, wherein said frame has a channel member at one end and a retainer slot at a second end, and wherein the attachment bracket open channel comprises a saddle for receiving the channel member, and the nose portion sliding into the retainer slot when the channel member is received in the saddle.

4. A mounting plate assembly for attachment to an accessory attachment plate of a skid steer loader, comprising a mounting plate, an attachment bracket supported on a forwardly facing surface of the mounting plate, said attachment bracket having frame supports thereon, and a frame for releasably mounting on said supports of the attachment bracket, said frame having a channel member at one end and a retainer slot at a second end, and wherein the attachment bracket supports include a saddle for receiving the channel member and a nose portion that slides into the retainer slot when the channel member is received in the saddle, and wherein said mounting plate has a transverse stiffener on a forward surface thereof, said attachment bracket being supported on said stiffener, and along the mounting plate, and a brace plate attached to support side loads on the attachment bracket back to the mounting plate, said frame being attached to a working tool.

* * * * *